United States Patent [19]

Gundlach et al.

[11] 4,086,027

[45] Apr. 25, 1978

[54] SHROUDED ROTOR BLADE ANNULUS FOR A CENTRIPETAL TURBINE STAGE

[75] Inventors: Władysław Gundlach, Lodz; Jerzy Porochnicki, Czestochowa; Jerzy Prywer, Lodz; Bogusław Karewicz, Lodz; Andrzej Potapczyk, Lodz; Krzysztof Zielenow, Lodz, all of Poland

[73] Assignees: Politechnika Lodzka, Lodz; Zaklady Mechaniczne im. Gen. Karola Swierczewskiego "Zamech", Elblag, both of Poland

[21] Appl. No.: 564,991

[22] Filed: Apr. 4, 1975

[30] Foreign Application Priority Data

Apr. 12, 1974 Poland ..... 170332

[51] Int. Cl.[2] ..... F01D 3/02

[52] U.S. Cl. ..... 416/184; 416/199

[58] Field of Search ..... 416/184, 183, 199, 186, 416/191–193

[56] References Cited

U.S. PATENT DOCUMENTS

| | | | |
|---|---|---|---|
| 1,112,324 | 9/1914 | Rice | 416/184 |
| 1,258,462 | 3/1918 | Rice | 416/184 |
| 2,155,231 | 4/1939 | Hubbard et al. | 416/184 |
| 2,784,936 | 3/1957 | Schmidt | 416/186 |
| 3,782,851 | 1/1974 | Hackbarth et al. | 416/186 X |

FOREIGN PATENT DOCUMENTS

| | | | |
|---|---|---|---|
| 1,022,176 | 3/1953 | France | 416/186 |
| 601,966 | 3/1926 | France | 416/184 |
| 462,853 | 7/1928 | Germany | 416/183 |
| 755,198 | 11/1952 | Germany | 416/186 |
| 482,965 | 7/1953 | Italy | 416/186 |
| 445,005 | 4/1936 | United Kingdom | 416/184 |
| 925,943 | 5/1963 | United Kingdom | 416/186 |
| 941,343 | 11/1963 | United Kingdom | 416/186 |
| 308,215 | 8/1971 | U.S.S.R. | 416/184 |
| 179,414 | 4/1966 | U.S.S.R. | 416/186 |

*Primary Examiner*—Everette A. Powell, Jr.
*Attorney, Agent, or Firm*—Edwin E. Greigg

[57] ABSTRACT

A shrouded rotor blade annulus for a double flow centripetal turbine stage, comprising a center row of radial blades and two end rows of axial blades mounted on the periphery of a turbine rotor disc or drum, and two segmented annular shrouds, each covering the top of an axial blade row and one side of the radial blade row, with the shroud segments being integral with the axial blades. In an alternate embodiment, the radial blades are integral with shroud segments forming the side portion of the two shrouds adjacent these radial blades and the axial blades are integral with adjacent shroud segments forming the deck portion of these shrouds and covering the axial blade rows.

2 Claims, 7 Drawing Figures

SHROUDED ROTOR BLADE ANNULUS FOR A CENTRIPETAL TURBINE STAGE

The object of the invention is a shrouded rotor blade annulus for a centripetal turbine stage, particularly intended for use with bit power steam turbines.

In known turbines having an annular inlet passage of variable or constant cross-section the change in the direction of steam flow is effected along the periphery. The inlet passage is confined from the side of the rotor axis with profiled inserts to equalize the velocity field at the inlet into the first axial stages. Despite this, by virtue of considerable unevenness of the velocity field in the inlet passage and a change of flow direction by 90°, the distribution of the velocity field at the inlet is uneven to such extent that it lowers the efficiency of the first axial stage and increases forces that excite vibrations of blading.

The application of centripetal stages in axial-flow turbines to obviate this disadvantage is obstructed mainly because of strength reasons. The axial displacement of the rotor, in relation to the stator, encountered during starting and stopping of the turbine makes it impossible to use open wheels which are the most reliable as regards their strength, but also the least efficient because of greater axial clearances which cause considerable leakage loss. The value of peripheral speed at the outer diameter of centripetal wheels and the value of pitch diameter at their outlet which are dependent on the size of axial stages, exclude in turn the possibility of the application of shrouded wheels with ring-shaped covers which provide the maximum efficiency.

In order to offset this disadvantage use has been made in the steam turbine of the shrouded rotor blade annulus of the centripetal stage, according to the invention, composed of a row of radial blades as well as of one or two rows of axial blades mounted on a rotor disc or drum; the radial or axial blades are integral with segments of the side shrouds of the rotor annulus.

The rotor blade rim annulus of the centripetal stage according to the invention, reduces the operating costs of the turbine, it namely improves the efficiency of the first axial stages by at least 5% since the change in the direction of flow from radial to axial proceeds in a high convergent rotating vane passages in an accelerating flow, hence with small losses of energy and with equalized velocity field at the exhaust from the centripetal wheel. In addition, the application of an centripetal stage makes for more economical machine and powerplant initial costs, since it permits reducing the number of blade rows and this enables shortening the length of the rotor and casing and reducing the machine weight.

The object of the invention is exemplified in the drawing in which

Figure 1:
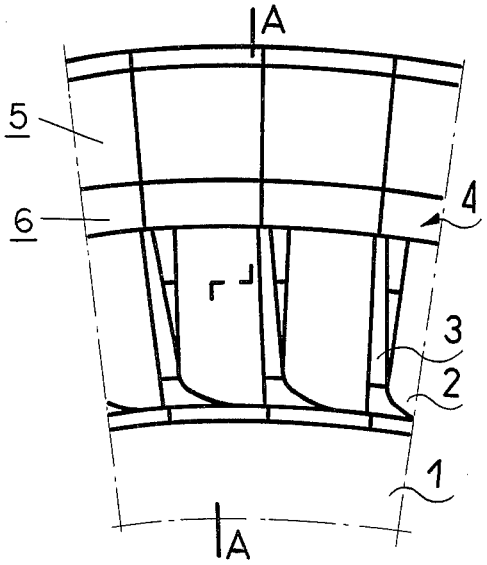
FIG. 1 represents a segment of a shrouded motor blade annulus shown in the direction coinciding with the turbine axis.

Referring now to FIGS. 1–4, on the outer rim of the wheel or rotor drum 1 are mounted two rows of axial blades 2 and between them a row of radial blades 3. The axial blades 2 are integral with the side portions 5 of the shrouds 4 of the rotating rim.

Figure 2:
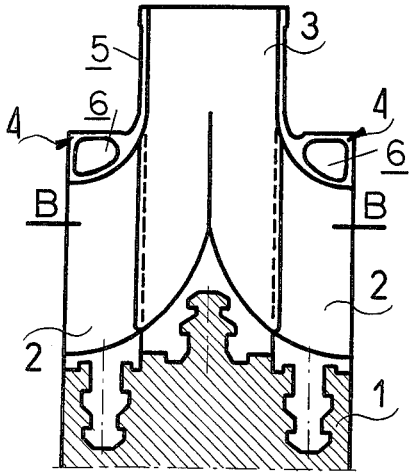
FIG. 2 is an axial sectional view of a portion of a shrouded rotor blade annulus of a centripetal inlet double flow turbine, in which the side portions of the shroud are integral with the axial blades, taken along the line A—A of FIG. 1.
Figure 3:
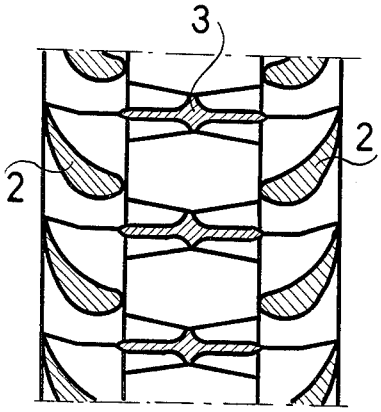
FIG. 3 is a radial sectional view of the embodiment of FIG. 2, taken along the line B—B of FIG. 2.
Figure 4:
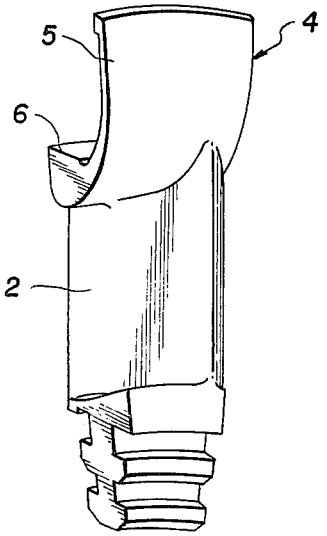
FIG. 4 is a perspective view of the axial blade of FIG. 2.

As seen in FIGS. 1 and 2, the two segmented annular shrouds 4 each include a side portion 5 covering one side of the row of radial blades 3 and a deck portion 6 covering the top of one row of axial blades 2, with the inside surface of shrouds 4 forming parts of the passages in which the direction of steam flow is changed from a radial direction to an axial direction. The shroud segments integral with the blades 2 include both the side 5 and deck 6 portions of the shroud 4, so that the total number of segments comprising these shrouds equals the total number of axial blades 2.

Figure 5:
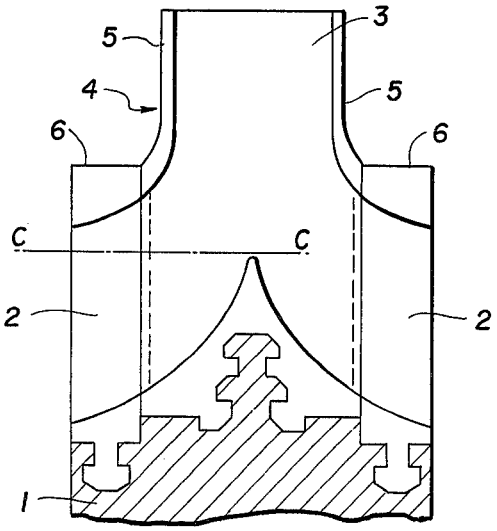
FIG. 5 is an axial sectional view, similar to FIG. 2, of an alternate embodiment of the invention, in which the side portions of the shroud are integral with the axial blades.
Figure 6:
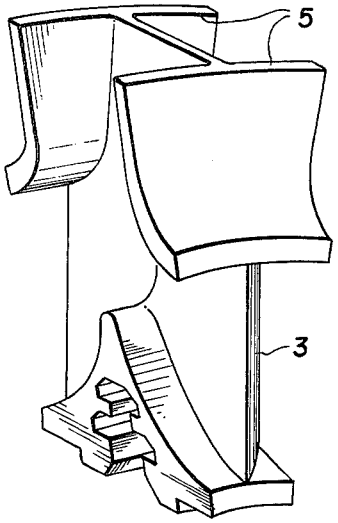
FIG. 6 is a perspective view of the radial blade of FIG. 5.
Figure 7:
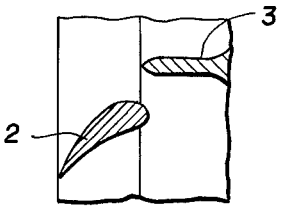
FIG. 7 is a radial sectional view of the embodiment of FIG. 5, taken along the line C—C of FIG. 5.

FIGS. 5–7 illustrate a modification of this invention, in which the elements 1–6 of FIGS. 5–7 correspond to the similar elements 1–6 of the embodiment of FIGS. 1–4. Essentially, the only difference between these two embodiments is that in the embodiment of FIGS. 5–7, the shroud segments which form the side portion 5 of the shrouds 4 are integral with the radial blades 3, as best seen in FIG. 6. Thus, the total number of segments comprising the shrouds 4 will equal the total number of radial and axial blades 2, 3, since the segments comprising the deck portion of these shrouds 4 remain integral with the axial blades 2.

In both embodiments, the forces of inertia acting upon the cover 4 during rim rotation efficiently dampen vibrations of the blades 2 and 3.

We claim:

1. A shrouded rotor blade annulus structure for a centripetal double flow turbine stage, which comprises:
   - one row of radial blades;
   - two rows of axial blades disposed on opposite sides of the row of radial blocks; and
   - two segmental annular shrouds each covering the top of one row of the axial blades and one side of the row of radial blades,
   - wherein the axial blades are integral with shroud segments comprising the two annular shrouds.

2. A shrouded rotor blade annulus structure for a centripetal double flow turbine stage, which comprises:
   - one row of radial blades;
   - two rows of axial blades disposed on opposite sides of the row of radial blades; and
   - two segmented annular shrouds, each covering the top of one row of axial blades and one side of the row of radial blades;
   - wherein the axial blades are integral with shroud segments comprising the portions of the shrouds covering the tops of the two rows of axial blades, and the radial blades are integral with shroud segments comprising the portions of the shrouds covering both sides of the row of radial blades.

* * * * *